United States Patent [19]

Kusano et al.

[11] Patent Number: 4,556,817

[45] Date of Patent: Dec. 3, 1985

[54] PHOTOELECTRIC CONVERSION APPARATUS

[75] Inventors: Chushirou Kusano, Tokorozawa; Sachio Ishioka, Tokyo; Yoshinori Imamura, Kanagawa; Yukio Takasaki; Hirofumi Ogawa, both of Hachioji; Tatsuo Makishima, Hachioji; Tadaaki Hirai, Koganei; Eiichi Maruyama, Kodaira, all of Japan

[73] Assignee: Hitachi, Ltd., Tokyo, Japan

[21] Appl. No.: 547,962

[22] Filed: Nov. 2, 1983

[30] Foreign Application Priority Data

Nov. 4, 1982 [JP] Japan ..... 57-192476

[51] Int. Cl.[4] ..... H01J 29/45; H01J 31/26

[52] U.S. Cl. ..... 313/371; 313/386; 313/387; 313/390

[58] Field of Search ..... 313/384, 387, 388, 386, 313/385, 366, 371

[56] References Cited

U.S. PATENT DOCUMENTS

| | | | |
|---|---|---|---|
| 3,858,079 | 12/1974 | Miyama et al. | 313/384 X |
| 3,946,264 | 3/1976 | Crowell | 313/388 |
| 4,166,969 | 9/1979 | Hoeberechts | 313/384 X |
| 4,331,506 | 5/1982 | Sasano et al. | 313/386 X |
| 4,492,981 | 1/1985 | Taketoshi et al. | 313/384 X |

*Primary Examiner*—Palmer C. DeMeo

*Attorney, Agent, or Firm*—Antonelli, Terry & Wands

[57] ABSTRACT

An image pickup tube of high velocity electron beam scanning and negatively charging system having a target including, on a transparent substrate, at least a transparent conductive film, a photoconductive layer, a layer for emitting secondary electrons, and stripe electrodes. The transparent substrate may be made of amorphous silicon.

14 Claims, 9 Drawing Figures

PHOTOELECTRIC CONVERSION APPARATUS

The present invention relates to an image pickup tube of the type in which scanning is performed by using a high velocity electron beam.

Methods having a practical use at present for obtaining various color signals from a single image pick-up tube can be generally classified into three as follows:

(1) Tri-electrode method;

(2) Frequency division multiplex method; and (3) Phase separation method.

The tri-electrode method is such that red, green and blue color signals are respectively obtained from three electrodes provided independently of each other and constituted by transparent stripe electrodes. The method is disadvantageous in that the construction of the target is complicated and crosstalk is apt to occur among signal electrodes, while it is advantageous in simplicity of the signal processing circuit system of a camera, in good color reproducibility, and in good operating stability.

The frequency division multiplex method is such that tri-color signals are multiplexed in a space frequency region by using crossed type stripe color filters. This method is disadvantageous in that the operation is not stable because of complication of circuit, in that an image pickup tube of high resolving power is required, in that color shading is apt to occur due to the non-linear characteristic of deflection, etc., while it has an advantage that the sensitivity as well as the resolving power are high.

The phase separation method is such that an index signal for color encoding is superimposed on an output signal from an image pickup tube so as to obtain color signals on the basis of the superimposed signals, the index signal being obtained by means of transparent stripe electrodes. This method is advantageous in that there is no crosstalk among color signals and in that the color reproducibility is good in comparison with the frequency division multiplex method. This method is, however, disadvantageous in that it is required to perform machining of transparent electrodes and in that the light utilization rate is poor and the sensitivity is low.

Recently, image pickup tubes generally employ a low velocity electron beam scanning method (hereinafter referred to as an LP method) and therefore have two common problems, one being that a lag is long and particularly color lag is apt to occur and the other being that distortion and color shading are apt to occur in a picture image due to beam bending.

As to the problems of lag and beam bending occurring in the LP method, it is known to be able to solve such problems by employing a high velocity electron beam scanning method. This method is disclosed, for example, in Japanese Patent Application Laid-open No. 44487/Sho54(1979); in J. Dressner, "High Beam Velocity Vidicon", RCA Review, June (1961), P.P. 305–324; etc. This method is disadvantageous in that a spurious signal may be generated due to the redistribution of secondary electrons. As a countermeasure, there has been proposed a method in which mesh electrodes are directly attached to the surface of the target to thereby improve the above-mentioned disadvantage. However, new problems such as generation of a beat pattern, deterioration in resolving power, etc. are generated in the proposed method due to the provision of such mesh electrodes so that a sufficient performance can not be obtained. As an example of publication disclosing such a proposed method, there is U.S. patent application Ser. No. 491,291, entitled "Image Pickup Tube", filed on May 5, 1983 by Chushirou KUSANO, Sachio ISHIOKA, Yoshinori IMAMURA, Yukio TAKASAKI, Hirohumi OGAWA, Tatuo MAKISHIMA, and Tadaaki HIRAI. This U.S. Application discloses a technique as to a target of a negative charge image pick-up tube constituted by amorphas silicon, etc., and employing the high velocity electron beam scanning method.

An object of the present invention is to provide a novel image pickup tube distinguishable from the conventional ones, in which any spurious signal generated in the conventional system due to the redistribution of secondary electrons may be prevented from occurring and in which an index signal can be obtained.

Another object of the present invention is to provide an image pickup tube of high resolving power.

The image pickup tube according to the present invention is provided with a target having such an arrangement as follows and the above-mentioned objects of the present invention can be attained by scanning the target by a high velocity electron beam. That is, the target of the image pickup tube according to the present invention is provided with a transparent conductive film, a photoconductive layer, a layer for emitting secondary electrons and stripe electrodes provided on a surface to be scanned by an electron beam. The scanning by a high velocity electron beam is performed in the direction intersecting the stripe electrodes.

It is a matter of course that the above-mentioned image pickup tube can be used as a single-tube type color image pickup tube if stripe filters are provided therein.

The above and other objects, features and advantages of the present invention will be apparent from the following detailed description of preferred embodiments thereof taken in conjunction with the accompanying drawings, in which.

Although the following description of the present invention will be made as to an embodiment of a single-tube type color image pickup tube, the embodiment may be applied to monochromatic image pickup tube if color filters are omitted, or may be applied to multitube type (such as two, three, four tube type, etc.) color image pickup tube.

Figure 1:
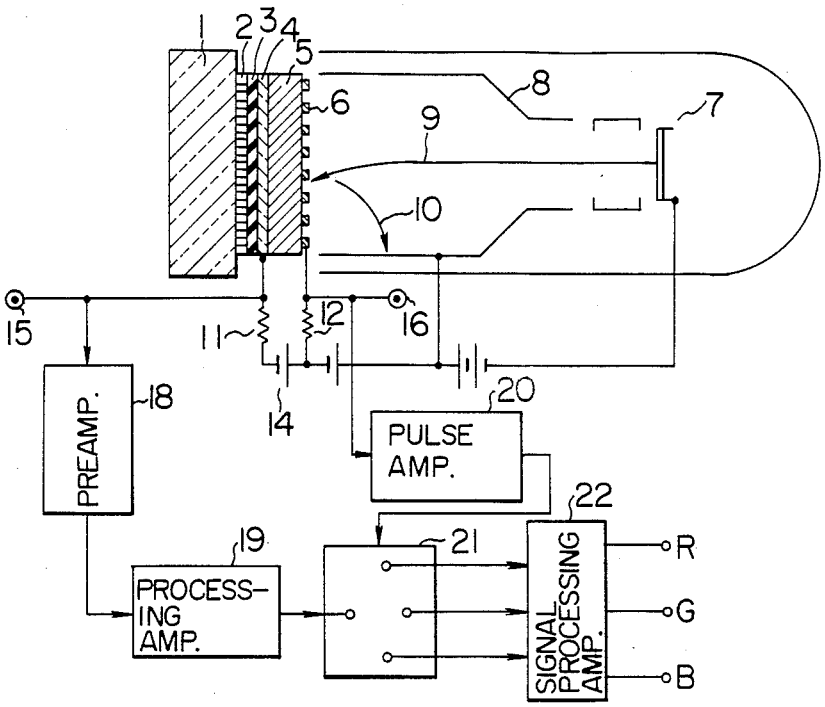
FIG. 1 is a diagram for explaining a single tube type image pickup tube according to the present invention.
Figure 2:
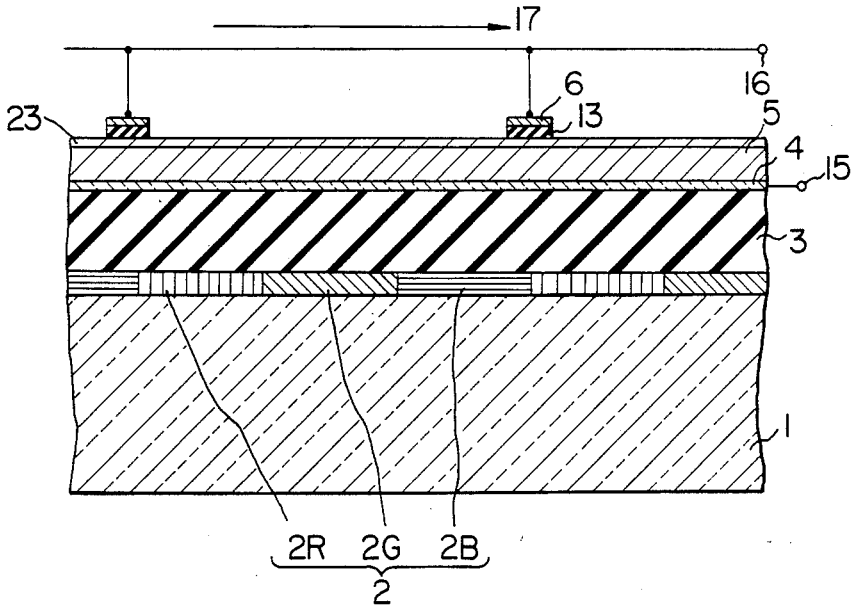
FIG. 2 is a cross-section of an example of the target of the image pickup tube according to the present invention.

FIGS. 1 and 2 are schematic diagrams for explaining the principle of operation of the image pickup tube according to the present invention. In the drawings, color encoding stripe filters 2 are formed on a transparent substrate 1. An insulating layer 3 is formed on the stripe filters 2, and a transparent electrode 4 formed on the insulating layer 3 is connected to an output terminal 15. An electrically-conductive transparent film is used as the electrode 4. A photoconductive layer 5 is formed on the transparent electrode 4 so that light passed through the filters 2 is absorbed in this layer 5 to generate electron-hole pairs therein. A layer 23 for emitting secondary electrons is usually formed on the photoconductive layer 5 by using a material as usually formed on the photoconductive layer 5 by using a material as described later, while it is not always necessary to newly provide such a layer 23 in principle. Alternatively, the surface of the photoconductive layer 5 may be used as such a layer 23. Stripe electrodes 6 are formed, through stripe insulating layers 13, on the surface of the photoconductive layer 5 on the side thereof which is to be scanned by an electron beam 9, the stripe electrodes 6 being arranged such that each of the stripe electrodes 6 extends in parallel with the stripe filters 2 and intersects the scanning direction of the electron beam 9. The stripe electrodes 6 are commonly externally led out through an output terminal 16.

It is required that the secondary electron emission layer 23 has a secondary electron-emission yield (hereinafter referred to as "δ") which is 1 or more with respect to the scanning electrons accelerated by the mesh potential of 0.1–2.0 kV in operation, has electric resistance of $10^{10}$ Ω-cm or more, and has large endurance for the electron-bombardment. The term "secondary electron-emission yield" is defined as a ratio of output electrons (secondary electrons) to input electrons (primary electrons). For example, in the case one primary electron is thrown and two secondary electrons are emitted, the electron-emission yield is "2". In this case, the layer from which the secondary electrons are emitted is charged in positive polarity. As a material to preferably satisfy the conditions as mentioned above, oxide or fluoride, such as MgO, BaO, $CeO_2$, $Nb_2O_5$, $Al_2O_3$, $SiO_2$, $MgF_2$, $CeF_4$, $AlF_3$, may be selectively used. It is preferable to select the thickness of the layer 23 to be 3 nm (nano meter) to 30 nm.

The target as described above is used in operation such that, usually, a high positive voltage, such as 100 V or more, with respect to a cathode 7 is applied to the transparent electrode 4 so that the value of δ is 1 or more. At this time, the potential of the stripe electrodes 6 formed on the scanned surface of the target is set to be higher than that of the transparent electrode 4. If electron beam scanning is performed under this condition, the surface of the photoconductive target emits secondary electrons 10 so that the potential of the scanned surface becomes in equilibrium with that of the stripe electrodes 6 so as to take a positive value with respect to the transparent electrode 4. That is, since the value of δ is 1 or more, electrons which are larger in number than those shot onto the surface of the target by the electron beam scanning are emitted therefrom. The secondary electrons 10 are emitted so long as there exists a potential difference between the surface of the target and the stripe electrodes 6. If equilibrium has been once established between the surface of the target and the stripe electrodes 6, the secondary electrons emitted may come back to the surface of the target. Thus, the equilibrium state is maintained between the surface of the target and the stripe electrodes 6. Accordingly, the electric field applied to the photoconductive layer 5 is the reverse to that in the LP method so that electrons of electron-hole pairs generated by light drift toward the scanned surface side to thereby allow the potential of the scanned surface to negatively fall down on the contrary with the case of LP method. The surface of the target is then scanned by the electron beam 9 to thereby derive, through a load resistor 11, a signal representing the surface potential drop in accordance with the intensity of an optical image. This method is referred to as a high velocity electron beam scanning and negatively charging system (NH system).

The potential of the transparent electrode 4 is set to a value within a range of 100–2000 V with respect to the cathode 7. The potential of the stripe electrodes 6 is set to a value higher by several tens volts than the transparent electrode 4. This difference in potential means the potential actually applied to the photoconductive film, and the quality of material and the thickness of this photoconductive film are set depending on the characteristic required to the image pickup tube.

The inventors of this application have produced a single tube-type image pickup tube by using amorphous silicon containing hydrogen (hereinafter referred to as an a-Si:H) and found, as a result of conscientious consideration of the operation of the thus produced image pickup tube, a method in which the above-mentioned problems in the single-tube type image pickup tube in the LP method can be solved without deteriorating the feature of the high velocity electron beam scanning method.

The structure of the target of the image pickup tube according to the present invention will be described hereunder in detail. Basically, the target according to the present invention has the same structure as that of the HN system excepting that the former has the stripe electrodes provided in opposition to the stripe filters. FIG. 2 is a cross-section showing a typical example of the image tube target. In the same manner as in an ordinary target, the stripe filters 2 includes a plurality of filter sets each including, for example, a linear filter element 2R for allowing only red light (R light) to pass therethrough, a linear filter element 2G for allowing only green light (G light) to pass therethrough, and a linear filter element 2B for allowing only blue light (B light) to pass therethrough, the filter elements 2R, 2G and 2B being arranged adjacently to each other, the filter sets being periodically formed on the transparent substrate 1 of a material such as glass. A known organic filter, or an inorganic filter such as a multi-layer interference tube filter may be used as the element of the filters 2. The stripe electrodes 6 are formed on the beam scanned surface of photoconductive layer on the opposite side to the stripe filters 2, at intervals in synchronism with the period of the respective filter set (2R, 2G and 2B). It is not necessary to make the stripe electrodes 6 transparent but any material may be used for them so long as it has high conductivity. That is, a metal material (such as Cr-Au layers, Cr-Al layers, Mo, etc.) may be used to form the stripe electrodes 6. The thickness of the stripe electrodes 6 is selected to be a value within a range of about 500 Å -1 μm. Although the stripe electrodes 6 may be further thicker than the value as mentioned above, it becomes difficult to produce them and there is no particular advantage in production in order to achieve the expected object. In FIG. 2, although each of the stripe electrodes 6 is formed such that it agrees with the boundary between the filter elements 2R and 2B, it is not always necessary to arrange the stripe electrodes 6 in this manner. In a word, it is important to arrange the stripe electrodes in synchronism with the stripe filter sets.

The insulating film 13 is made of a material such as $SiO_2$, $Si_3N_4$, $Al_2O_3$, or the like and the thickness thereof is selected to be a value within a range of about 1000 Å–2 μm since it is sufficient so long as it attains insulation. There is no particular advantage even if the thickness is further increased than the value in the above-mentioned range.

Although FIG. 2 shows the case where the transparent insulating layer 3 is arranged between the stripe filters 2 and the transparent electrode 4, the transparent electrode 4 may be formed, alternatively, directly on the stripe filters 2. In the latter case, there occurs little optical crosstalk so that good color reproducibility can be obtained. As the insulating film 3, a piece of thin plate glass (having a thickness of about 20–30 μm) is usually used.

Figure 3:
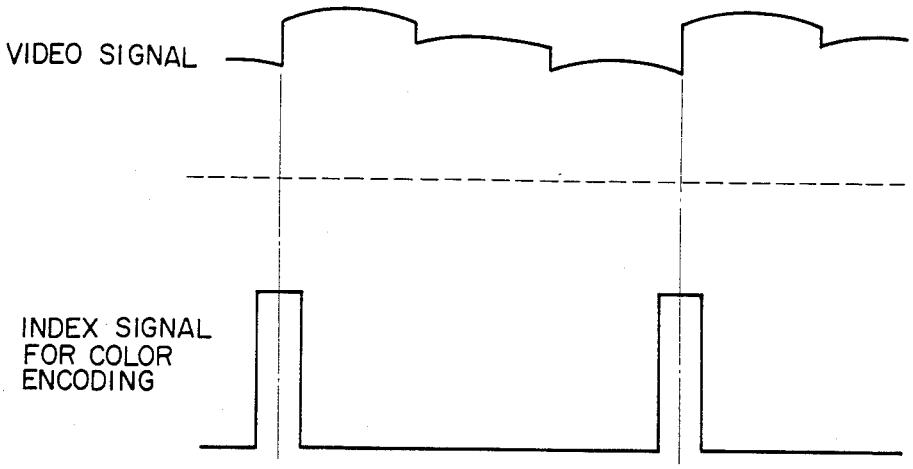
FIG. 3 shows waveforms of a video signal and an index signal for color encoding obtained in FIG. 2.

In the arrangement as shown in FIG. 2, electric charges generated in the photoconductive layer 5 by the light passed through the stripe filters 2 are scanned by the electron beam so that a video signal having a waveform corresponding to the period of the stripe filters 2 as shown in FIG. 3 is produced through the load resistor 11 connected to the transparent electrode 4 (see FIG. 1). This signal is processed, for example, in such a manner as follows through a circuit system of FIG. 1. That is, the video signal obtained through the load resistor 11 is inputted into a color encoding switching circuit 21 through a preamplifier 18 and a processing amplifier 19.

The scanning direction by the electron beam 9 is set as indicated by an arrow 17 as shown in FIG. 2 such that it intersects the stripe filters 2 and the stripe electrodes 6. At this time, the electron beam 9 passes over the stripe electrodes 6 as it scans the target surface so that a signal having such a waveform including no video signal as shown in FIG. 3 can be obtained through a resistor 12 correspondingly to period of the stripe electrodes 6. This signal can be used as an index signal for color encoding. As shown in FIG. 1, the index signal, which can be obtained through the resistor 12, is amplified and shaped in a pulse amplifier 20 and then inputted into the color encoding switching circuit 21. In the switching circuit 21, switching is made in synchronism with the respective stripe elements (2R, 2G, 2B) of the stripe filters 2 on the basis of the index signal so as to color-encode the video signal from the processing amplifier 19 to thereby obtain color television signals (R,G,B) through a signal processing amplifier 22.

The system in which an index signal is obtained according to the present invention can be realized only in the arrangement and system of the image pickup tube according to the present invention.

In the LP method, the velocity of the electron beam landing on the scanned surface is nearly zero so that the electron beam is apt to be affected by the potential distribution on the scanned surface. If the potential of the stripe electrodes 6 is set to be equal to the cathode potential, for example, the scanned surface potential rises to be higher than the potential of the stripe electrides 6 so that the electron beam can not attain landing onto the stripe electrodes 6 and no index signal can be therefore obtained. If the potential of the stripe electrodes 6 is set to be higher than the cathode potential, on the contrary, the electron beam 9 is bent by the potential of the stripe electrodes 6 so that the electron beam can not scan the target surface and no video signal can be therefore obtained.

Figure 4:
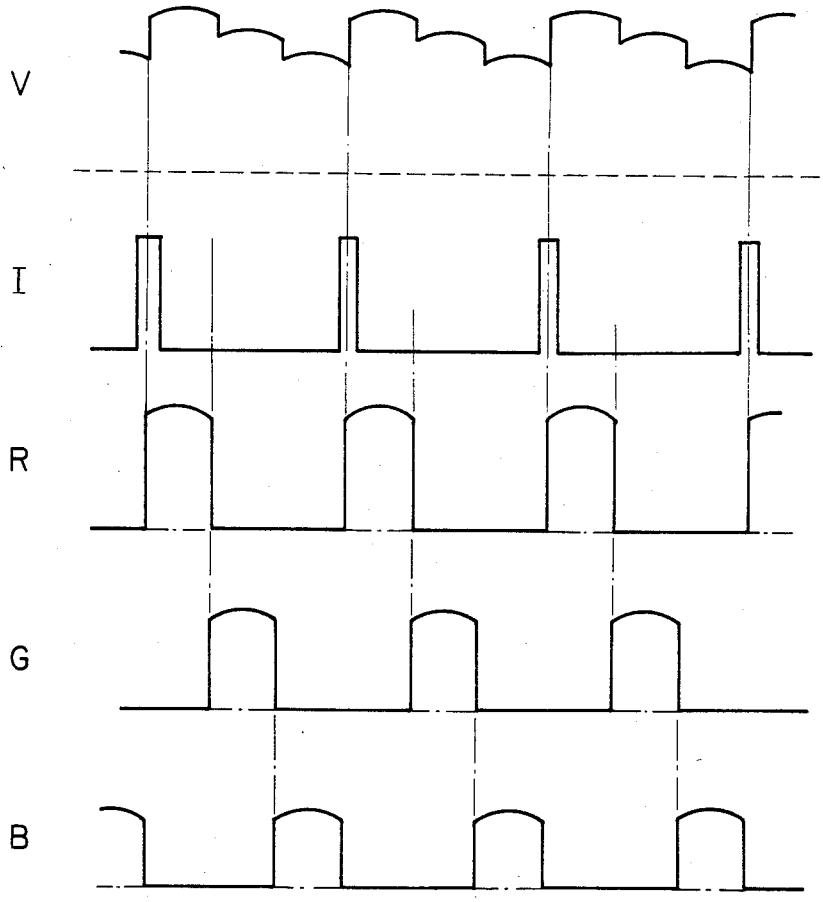
FIG. 4 shows waveforms of a video signal V, an index signal I, and separated color signals R, G and B.

FIG. 4 shows an example of the relation in waveform between the index signal and the respective decomposed color signals. In FIG. 4, V represents a waveform of the video signal corresponding to the light passing through the stripe filters 2 and being obtained through the terminal 15 by the electron beam scanning, and I represents a waveform of the index signal obtained through the stripe electrodes 6 by the high velocity electron beam scanning. The video signal waveform V is decomposed, for example, into three waveforms R, G and B, as shown in FIG. 4, in the color encoding switching circuit 21 through the preamplifier 18 and the processing amplifier 19 and on the basis of the index signal I, as seen in FIG. 1. That is, the video signal V is decomposed into the color signals corresponding to the respective stripe filter elements 2R, 2G and 2B. From the thus decomposed color signals, color television signals of an NTSC (National Television System Committee) system can be obtained through a signal processing amplifier 22.

The above-mentioned color encoding method according to the present invention is described merely by way of example and the important fact is that an index signal is obtained by high velocity electron beam scanning through stripe electrodes formed on a beam scanning surface of an image pickup tube target and a video signal generated by light passing through encoding stripe filters is decomposed into color signals by using the index signal.

Referring to FIG. 2, an example of the method of producing a target of the image pickup tube according to the present invention will described hereunder.

A transparent conductive film 4 is formed with tin oxide as its main material onto the thin plate glass substrate 3. Next, in an RF sputtering apparatus, the substrate 3 is disposed in opposition to a target of a high purity Si. After the apparatus has been exhausted to a high vacuum under $1\times10^{-6}$ Torr, a gas mixture of argon and hydrogen is led into the apparatus so that the pressure in the apparatus becomes $5\times10^{-4}$ -$5\times10^{-3}$ Torr. The concentration of hydrogen in the gas mixture is made to be 30–65%. The temperature of the substrate is set to 150°–300° C., and then reactive sputtering is performed so that an a-Si:H film 5 having a thickness of 0.5–4 μm is deposited onto the substrate on which the transparent electrode 4 has been formed. Then the substrate on which the a-Si:H film 5 has been deposited is disposed in opposition to a target of high purity $CeO_2$ in another RF sputtering apparatus. After the apparatus has been exhausted to a high vacuum under $1\times10^{-6}$ Torr, an argon gas is led into the apparatus so that the pressure in the apparatus becomes $5\times10^{-4}$-$5\times10^{-3}$ Torr. The temperature of the substrate is set to 100°–200° C., and then sputtering is performed, so that a layer 23 of cerium oxide is deposited as a secondary electron emitting layer onto the a-Si:H film 5 until the thickness of the layer 23 becomes 5 nm–50 nm.

Then $SiO_2$ films 13 are formed, in the form of stripe, at predetermined positions and metal electrodes, for example Cr-Au double layer films, in the form of stripe, are formed onto the $SiO_2$ films 13 respectively.

The thin plate glass of the thus prepared substrate is ground to a predetermined thickness. On the other hand, another transparent substrate 1 (for example a glass substrate) on which color filters (for example gelatin filters) have been disposed at predetermined positions is prepared. The thus prepared substrate 1 and the above-mentioned thin plate glass substrate 3 are stuck with each other to thereby complete a target. Alternatively, it will do to successively stack up the respective components on the transparent substrate 1.

The thus prepared photoconductive target is coupled with an HN system electron gun and the tube is evacuated and sealed to thereby obtain a photoconductive image pickup tube of the HN operation system.

Another example of the target structure will be described hereunder.

Figure 5:
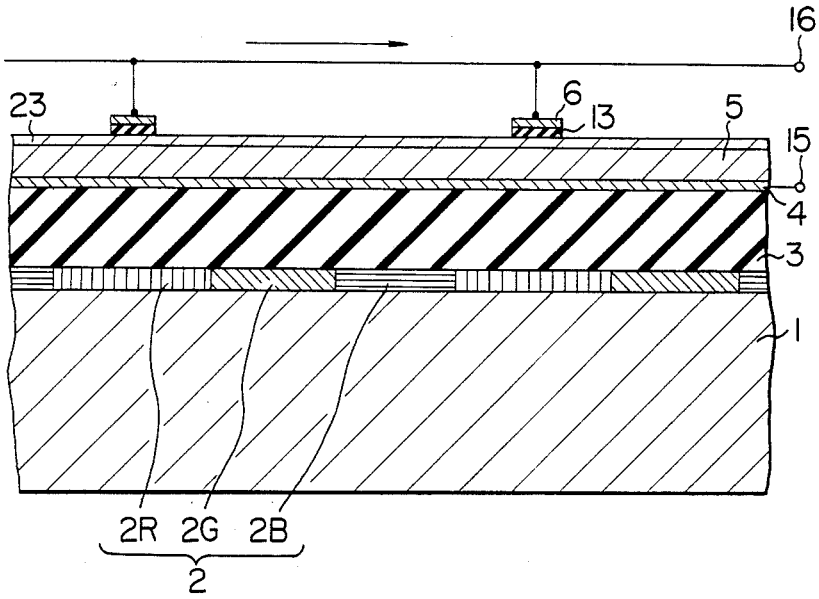
FIG. 5 is a cross-section of another example of the target of the image pickup tube according to the present invention.
Figure 6:
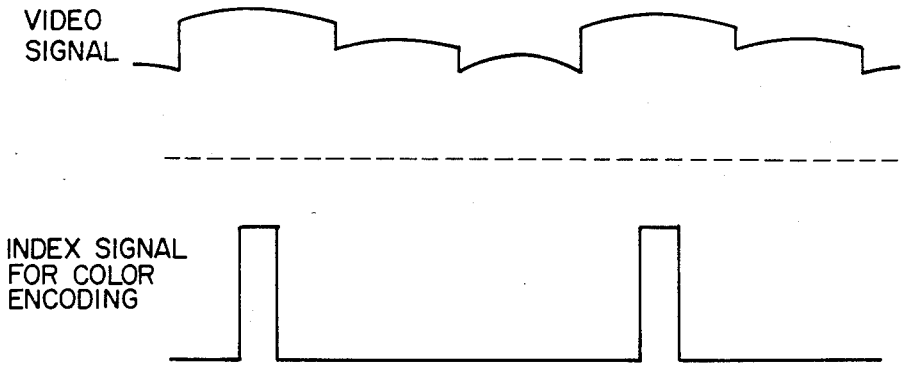
FIG. 6 shows waveforms of a video signal and an index signal for color encoding obtained in FIG. 5.

FIG. 5 shows another example of the target structure in which the respective filter elements (2R, 2G, 2B) of each set of the stripe filters 2 are different in width from each other and each stripe electrode 6 is provided not at the boundary between adjacent filter sets but provided in the middle portion of one filter element, for example 2R, of each filter set, while the stripe electrodes 6 are in synchronism with the respective sets of filters 2. In this embodiment, a video signal corresponding to the stripe filters 2 and an index signal from the stripe electrodes 6 can be obtained through the terminals 15 and 16 respectively by the electron beam scanning, as shown in FIG. 6. Color television signals can be obtained from these video and index signals by using such a circuit system as shown in FIG. 1. By making the respective elements of the filters 2 different in width from each other as described above, the balance of color signal of an image pickup tube can be desiredly designed. For example, in the case the photoconductive layer 5 has a low sensitivity with respect to B light, an image pickup tube having a high sensitivity with respect to B light can be obtained by making wider the width of each linear filter element 2B, which transmits only B light, than the other linear filters 2R and 2G. In the case stripe electrodes 6 are formed on the scanning surface as shown in the embodiments according to the present invention, all the signal charges stored in a portion covered by the stripe electrodes 6 on the scanning surface can not be eliminated by the electron beam scanning so that the sensitivity at the portion is lowered. The decrease in sensitivity in this case can be compensated by widening the width of each stripe filter element, for example 2R in FIG. 5, corresponding to the stripe electrode 6.

Figure 7:
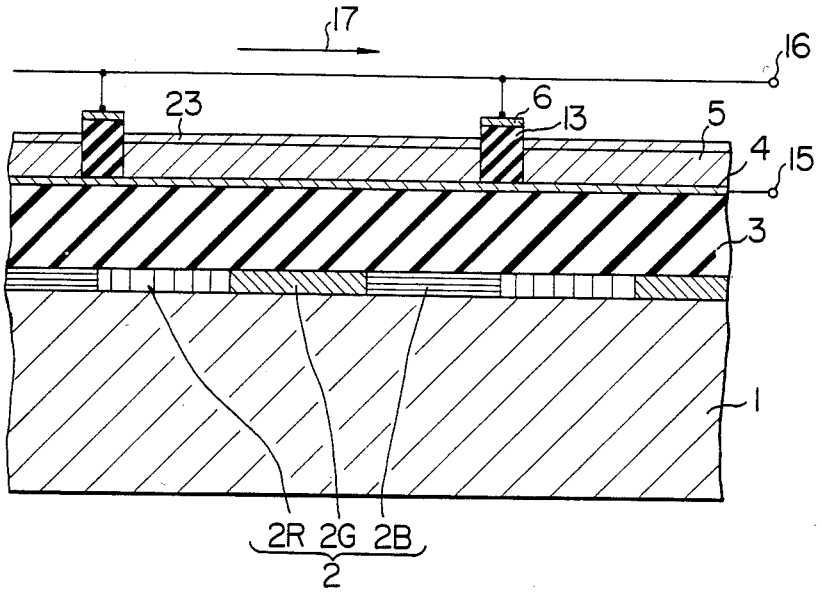
FIGS. 7, 8 and 9 show various examples of the target of the image pickup tube according to the present invention.

FIG. 7 shows a further embodiment in which the stripe insulating layer 13 for insulating each of the stripe electrodes 13 from the photoconductive layer 5 is formed directly on the transparent electrode 4 such that the photoconductive layer portion between the stripe electrides 6 and the transparent electrode 4 is omitted and the insulating layer portion is disposed thereat. By arranging the target structure in such a manner as described above, the formation of electron-hole pairs and the storage of electric charges can be obviated at the portions of the stripe electrodes 6 to thereby improving in lag and crosstalk.

Figure 8:
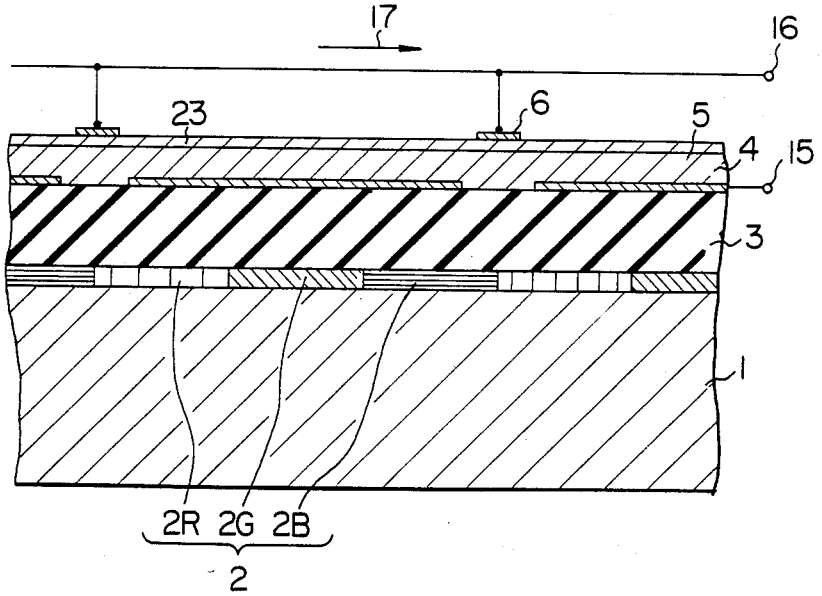

FIG. 8 shows a still further embodiment of the target structure in which in the transparent electrode 4, the region corresponding to each stripe electrode 6 is deleted and the stripe electrodes 6 are formed directly onto the photoconductive layer 5. In this embodiment, electric field is not applied to the regions of the photoconductive layer 5 corresponding to the stripe electrodes 6 and no signal charge is generated thereat so that the stripe electrodes 6 are substantially insulated from the photoconductive layer 5 to thereby obtain the same effect as in the above embodiment. It is a matter of course that the same effect can be obtained even if an insulating layer is disposed between each stripe electrode and the photoconductive layer 5 in FIG. 5.

Figure 9:
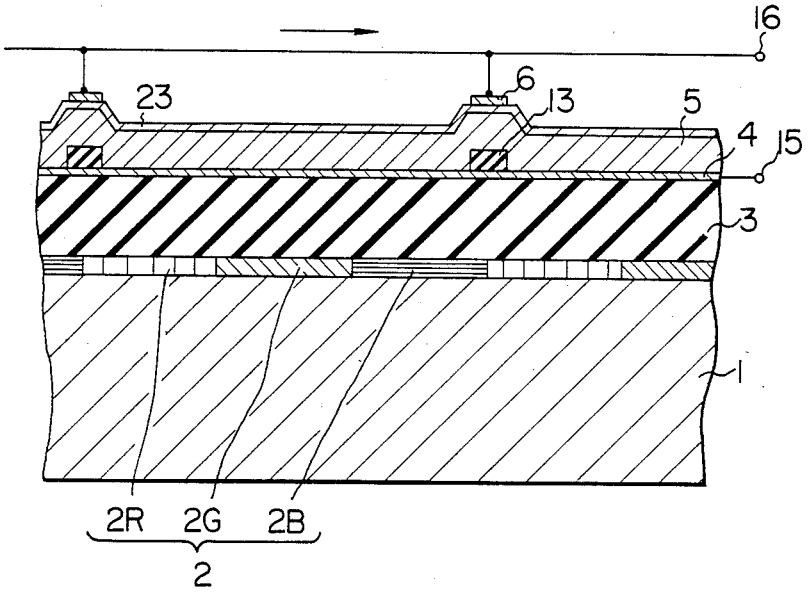

FIG. 9 shows a still further embodiment of the target structure in which the stripe insulating layer 13 is formed at a portion of the transparent electrode 4 corresponding to each stripe electrode 6 and the stripe electrodes 6 are formed directly onto the photoconductive layer 5. In this embodiment, electric field is not applied to the region between each stripe electrode 6 and the corresponding insulating layer 13 and no signal charge is generated thereat so that the same effect as in the above embodiment can be obtained.

Although the description has been made above with respect to the embodiments in which the stripe filters 2 are composed of red, green and blue filter elements, it is a matter of course that the present invention can be effectively realized by using filters of complementary colors of yellow, cyan and magenta colors and a filter of white color.

Conventionally, in the LP system, a field mesh electrode is provided near the target in order to improve the uniformity of the focus and deflection of electron beam. According to the present invention, on the other hand, a high positive voltage of 100 V or more is applied to the transparent electrode 4, so that such a field mesh is not always necessary and good imaging characteristic can be obtained without providing such a field mesh. This is a serious advantage in the industrial view point.

In order to sufficiently exhibit the above-mentioned effects of the present invention, it is preferable to arrange the structure such that the electrons and holes are prevented from being injected from the transparent electrode side as well as the beam scanning side. To attain this object, the characteristic of hetero-junction may be used in a reverse-biased state, or reversed characteristic of p-n junction may be used. Particularly, the structure is preferably arranged to prevent the hole injection from the stripe electrodes to the utmost because it may cause noises. In the embodiment of FIG. 2, the insulating layer 13 is provided to electrically insulate each stripe electrode 6 from the photoconductive layer 5.

According to the present invention, the material of the photoconductive layer 5 is not particularly restricted, and it will do to form the layer 5 such that the layer 5 may be applied to an ordinary photoconductive type image pickup tube and that the layer 5 is thin so that the value $\delta$ is 1 or more. It is preferable, however, as described as to the above-embodiments, to select a material suitable for the working processes such as chemical etching, plasma etching, or the like, because the stripe electrodes 6 have to be formed on the photoconductive layer 5. The inventors of the present application have produced an image pickup tube target according to the present invention by using amorphus silicon and found that amorphus silicon (a-Si:H) containing hydrogen is very suitable to the working processes and particularly good imaging characteristic can be maintained.

An a-Si:H photoconductive film can be obtained by a method of reactive sputtering in an atmosphere of a gas mixture of argon and hydrogen with Si plate as a target, by a glow discharge CVD method in an atmospheric gas containing at least $SiH_4$, or the like. Although the optical energy gap of the a-Si:H film may be largely changed depending on the temperature of substrate, the content of hydrogen gas, the quantity of impurity gas such as $SiF_4$, $GeH_4$ or the like, in forming the a-Si:H film, it is more preferable to select the energy gap of the a-Si:H film to be within a range from 1.4 eV to 2.2 eV according to the present invention. This is because that if the energy gap of the a-Si:H film is smaller than 1.4 eV, the dark resistivity becomes low to deteriorate the resolving power, and sensitivity appears to unnecessary near inflared rays, and if it exceeds 2.2 eV, on the contrary, the sensitivity to red light is low. The most preferable range is from 1.6 eV to 2.0 eV.

Although it will do to determine the thickness of the a-Si:H photoconductive film by reverse calculation from the light absorption coefficient and the required spectral photosensitivity of the image pickup tube, it is suitable to select the thickness within a range from 0.2 μm to 10 μm and it is more preferable to fall it within a range from 0.5 μm to 4 μm in view of the working voltage, the formation time, the probability of occurrence of surface fault, etc.

As described in detail above, the feature of the present invention is that stripe electrodes are provided on a beam scanning surface and scanned by a high velocity electron beam, so that a color encoding index signal can be obtained and color signals can be separated in a stable manner without occurring crosstalk. The present invention is advantageous in that there occur no beam-bending, no color shading, no color lag. etc.

Although the present invention has been described in detail above with respect to a single-tube type color image pickup tube, the present invention is not restricted to such a single-tube type color image pickup tube. That is, a monochrochromatic image pickup tube can be produced if the color filters is omitted in the abovementioned single-tube type color image pickup tube and, alternatively, multi-tube type color image pickup system can be provided if color filters are respectively provided in a plurality of image pickup tubes. In this cases, the arrangement of each image pickup tube becomes simple in comparison with the single-tube type color image pickup tube.

We claim:

1. A photoelectric conversion apparatus comprising a target including a transparent substrate, a transparent conductive film formed on said transparent substrate, a photoconductive layer formed on said transparent conductive film, a secondary electron emitting layer formed on said photoconductive layer, and stripe electrodes formed on said secondary electron emitting layer.

2. A photoelectric conversion apparatus according to claim 1, in which said target is scanned by a high velocity electron beam.

3. A photoelectric conversion apparatus according to claim 1, in which each of said stripe electrodes is provided through an insulating film having a predetermined shape.

4. A photoelectric conversion apparatus according to claim 2, in which each of said stripe electrodes is provided through an insulating film having a predetermined shape.

5. A photoelectric conversion apparatus according to claim 3, in which said insulating film under each of said stripe electrodes is provided in a groove formed through said photoconductive film and said secondary electron emitting layer.

6. A photoelectric conversion apparatus according to claim 4, in which said insulating film under each of said stripe electrodes is provided in a groove formed through said photoconductive film and said secondary electron emitting layer.

7. A photoelectric conversion apparatus according to claim 1, in which said transparent conductive film does not exist at a region under each of said stripe electrodes.

8. A photoelectric conversion apparatus according to claim 2, in which said transparent conductive film does not exist at a region under each of said stripe electrodes.

9. A photoelectric conversion apparatus according to claim 1, in which a plurality of sets of stripe filters are periodically provided on said transparent substrate, said stripe filters being different in spectral transmission coefficient.

10. A photoelectric conversion apparatus according to claim 9, in which in said target, stripe insulating films are provided on said transparent conductive film correspondingly to said stripe filter sets, said photoconductive layer and said secondary electron emitting layer are provided over said insulating films, and said stripe electrodes are provided corresponding to said stripe insulating films.

11. A photoelectric conversion apparatus according to claim 10, in which said target is scanned by a high velocity electron beam in the direction intersecting said stripe electrodes.

12. A photoelectric conversion apparatus according to claim 1, in which said photoconductive film is made of amorphus silicon containing at least hydrogen.

13. A photoelectric conversion apparatus according to claim 9, in which a signal obtained from said stripe electrodes is used as an index signal and a signal obtained from said transparent conductive film is used as a video signal.

14. A photoelectric conversion apparatus according to claim 1, in which in said target, electrons and holes are prevented from being injected from the transparent electrode side of said photoconductive layer and/or the electron beam scanning side of said photoconductive layer.

* * * * *